US008079342B2

(12) United States Patent
Muennich et al.

(10) Patent No.: US 8,079,342 B2
(45) Date of Patent: Dec. 20, 2011

(54) METHOD AND DEVICE FOR CONTROLLING AN INTERNAL COMBUSTION ENGINE

(75) Inventors: Christian Alexander Muennich, Schwaebisch Gmuend (DE); Volker Knoedler, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 742 days.

(21) Appl. No.: 12/284,548

(22) Filed: Sep. 22, 2008

(65) Prior Publication Data

US 2009/0090328 A1 Apr. 9, 2009

(30) Foreign Application Priority Data

Sep. 24, 2007 (DE) ..... 10 2007 045 564

(51) Int. Cl.
*F02D 13/06* (2006.01)

(52) U.S. Cl. ..... 123/198 F; 123/198 DB

(58) Field of Classification Search ..... 123/198 F, 123/198 DB

See application file for complete search history.

(56) References Cited

U.S. PATENT DOCUMENTS 5,433,182 A * 7/1995 Augustin et al. ..... 123/198 F
6,601,568 B1 8/2003 Muller

FOREIGN PATENT DOCUMENTS

GB 2140091 11/1984

* cited by examiner

*Primary Examiner* — Noah Kamen
(74) *Attorney, Agent, or Firm* — Kenyon & Kenyon LLP

(57) ABSTRACT

A method and a device for controlling an internal combustion engine having a plurality of cylinders. A fuel metering system includes a fuel reservoir. A fuel level signal is provided which characterizes the fuel level of the fuel reservoir. When the fuel level signal drops below a threshold value, a subset of the cylinders is shut off.

7 Claims, 3 Drawing Sheets

METHOD AND DEVICE FOR CONTROLLING AN INTERNAL COMBUSTION ENGINE

BACKGROUND INFORMATION

If, in an internal combustion engine, air enters into the fuel line and there, in particular into the injectors, considerable problems occur when the internal combustion engine is restarted. This is the case, for example, when the driver of the vehicle does not fill the tank in a timely manner and the fuel in the tank has been fully depleted, and the fuel pumping system aspires air which penetrates into the high-pressure zone. Such aspiration of air usually results in the internal combustion engine stalling immediately. The air may be easily removed from the lines, the pump, and the reservoir such as the rail, by de-aerating. If the air reaches the injectors, the injectors are much more difficult to de-aerate.

In particular in the case of injectors containing a hydraulic coupler, air penetration and the subsequent restart of the internal combustion engine are problematic.

It is known that such aspiration of air and the problem condition caused thereby may be avoided by shutting off the internal combustion engine in a timely manner. This means that the internal combustion engine is shut off when the tank contains a certain residual quantity of fuel. Such a shutoff is prohibited by law in certain countries. If such a measure of shutting off the internal combustion engine when the tank contains a residual quantity is not provided, a fuel tank running on empty and thus penetration of air into the fuel metering system cannot be prevented.

SUMMARY OF THE INVENTION

The device according to the present invention and the method according to the present invention have the advantage over the related art that restart of the internal combustion engine after running on empty is considerably simplified and in the case of an almost empty tank the internal combustion engine may be driven on, if necessary, until the tank is completely empty. Furthermore, the driver's attention is called to the almost-empty tank by the measures according to the present invention.

This is achieved according to the present invention by shutting off a subset of cylinders when there is a certain residual quantity of fuel in the tank. The cylinders are preferably shut off by suppressing the control of the injectors of these cylinders. This means that below a certain residual quantity of fuel in the tank a subset of the injectors is shut off. As a result, no air reaches the injectors of these cylinders. After the tank is filled, a start including the previously shut off cylinders is possible. For this purpose, a fuel level signal is provided which characterizes the fuel level in the fuel reservoir.

The number of cylinders that are shut off is selected in such a way that a restart of the internal combustion engine is possible with the aid of these shut-off cylinders, while a limp-home operation of the internal combustion engine is possible using the remaining cylinders. One-half of the cylinders is preferably shut off, while the other half of the cylinders continues to operate.

The cylinders are shut off as a function of a fuel level signal which shows the residual fuel quantity. A tank state signal or a signal of a fuel level indicator may be used as such a fuel level signal. Otherwise it may also be provided that the regular signal of an on-board computer regarding the residual range is used. It may thus be provided that the measure is initiated when reaching a certain residual range.

Furthermore, it is possible to draw a conclusion about the tank contents from the rail pressure dynamics and the rail pressure stability.

DETAILED DESCRIPTION

Figure 1:
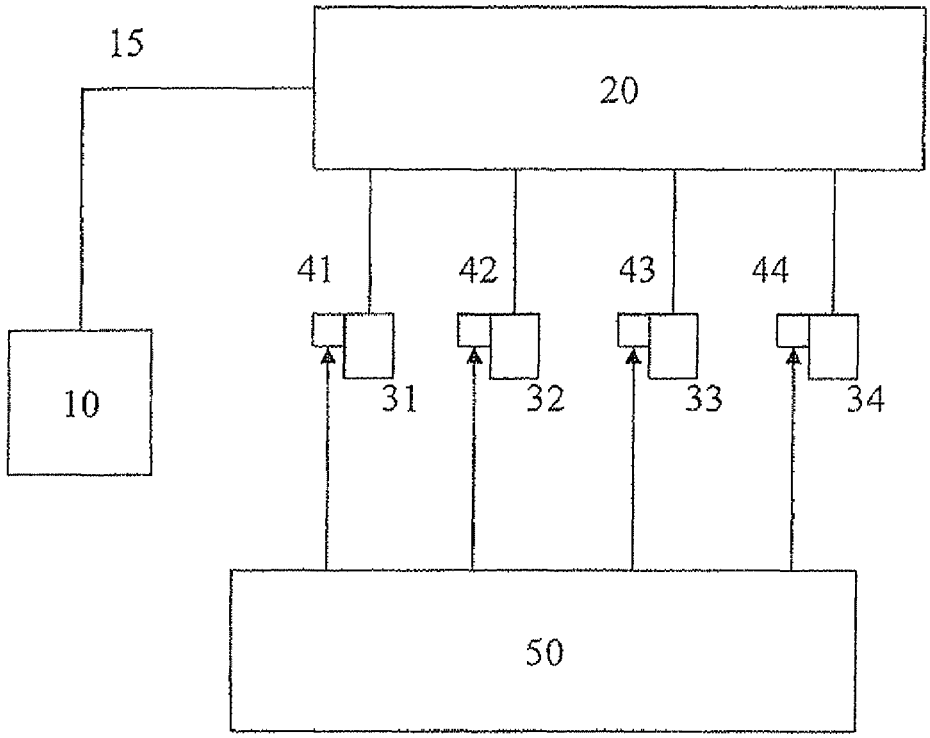
FIG. 1 shows a block diagram of a common rail system.
Figure 2:
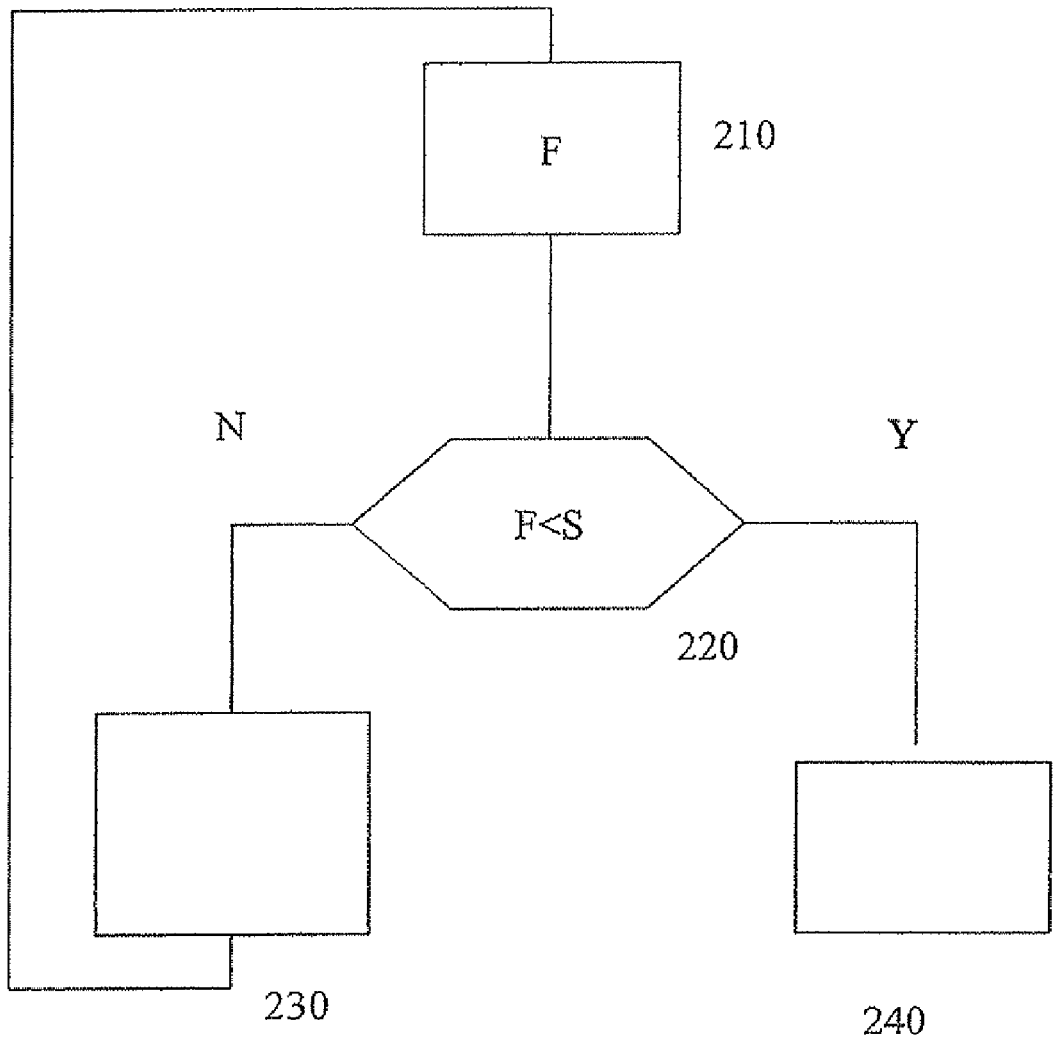
FIG. 2 shows a first flow chart which describes the shut-off of the internal combustion engine.

FIG. 1 shows the important elements of a fuel metering system which is referred to as a common rail system. The procedure according to the present invention is described below using the example of a common rail system. The procedure according to the present invention, however, is not limited to a common rail system, but may also be used in other fuel metering systems.

A fuel reservoir is labeled 10. The fuel is pumped therefrom by pumps (not depicted) to a high-pressure accumulator 20 via a line 15. From this high-pressure accumulator 20, the fuel reaches the combustion chambers (not depicted) of the internal combustion engine via injectors 31, 32, 33, and 34. Fuel metering by the injectors is controlled by actuators 41, 42, 43, and 44. These actuators are controlled with the aid of a control unit 50.

The fuel is pumped by a pre-supply pump and/or high-pressure pump into high-pressure accumulator 20. Due to the control of the injectors via actuators 41, 42, 43, and 44, injectors 31, 32, 33, 34, respectively, are controlled in such a way that, at a predefined point in time, they enable fuel metering and, at a second predefined point in time, they end fuel metering. If the fuel is depleted in fuel reservoir 10, air reaches the high-pressure accumulator, and thus also injectors 31 through 34, via line 15. If air reaches high-pressure accumulator 20 or the injectors, the pressure rapidly drops in high-pressure accumulator 20 and injection is no longer possible.

In particular in the case of injectors that include a so-called hydraulic coupler, the following problem arises. If only a small amount of air is in the injector, in particular in the coupler, control of fuel metering is no longer possible. De-aerating these injectors is also difficult, since a very high pressure is required therefor, which may only be provided when the engine is running.

Therefore, according to the present invention the following procedure is provided. Fuel level F of the tank is analyzed in a step 210. Different signals are available for this purpose. Thus, in a simple specific embodiment, a tank transducer showing the fuel quantity in the tank may be directly analyzed. Furthermore, systems are known in which an on-board computer calculates a residual range of the vehicle. This signal may also be used as fuel level F. Furthermore, it is recognized according to the present invention that, shortly before reaching the minimum fuel level and thus before imminent air aspiration, the rail pressure becomes unstable and the rail pressure dynamics change.

Penetration of air into the high-pressure system causes an upswing of the rail pressure amplitude in the rail pressure control. This is detected by a suitable functionality, in particular in steady-state driving states. In dynamic driving states, a lack of fuel supply is recognized by analyzing the rail pressure increase gradient compared to the required rail pressure increase. In addition, by monitoring the control parameters for deviations with respect to the values in normal operation, a conclusion is drawn regarding air in the fuel or lack of fuel supply.

If a fuel level F below a threshold value S is recognized in step 220, a subset of the injectors is shut down in step 240. At the same time, a bit is set indicating that a shutoff has taken place.

If query 220 recognizes that the fuel level is still sufficient, normal operation takes place in step 230. This is followed again by step 210.

The number of injectors to be shut off is selected in such a way that the number of shut-off injectors is sufficient for reliable engine start. On the other hand, the number of injectors that are not shut off is selected in such a way that reliable limp-home operation is possible. In an internal combustion engine having four cylinders, normally two cylinders are shut off. In an internal combustion engine having a higher number of cylinders, preferably a higher number of cylinders is shut off. Preferably only two cylinders are further operated when reaching minimum fuel level S.

According to the present invention, a subset of the injectors is thus no longer controlled in the event of an indication of an existing or imminent penetration of air into the fuel metering system. This takes place, for example, when a fuel level in tank 10 drops below a calibratable level and/or in the event of a recognizable rail pressure instability. The shut-off prevents air from penetrating into the injectors; therefore restart is possible using these injectors after the tank is refilled.

These injectors, which are no longer controlled, remain closed until a sufficient tank level or a sufficiently stable rail pressure is present again. At least as many injectors are always shut off as needed for the next start and at most as many as may be omitted for a safe limp-home operation. Timely shut-off prevents or at least reduces penetration of air into these shut-off injectors. At the next start, these injectors are thus still in a condition that enables a function of the hydraulic coupler. Injection is thus ensured which allows the engine to restart after the cause of the air penetration is removed and possibly to de-aerate the rest of the system.

Figure 3:
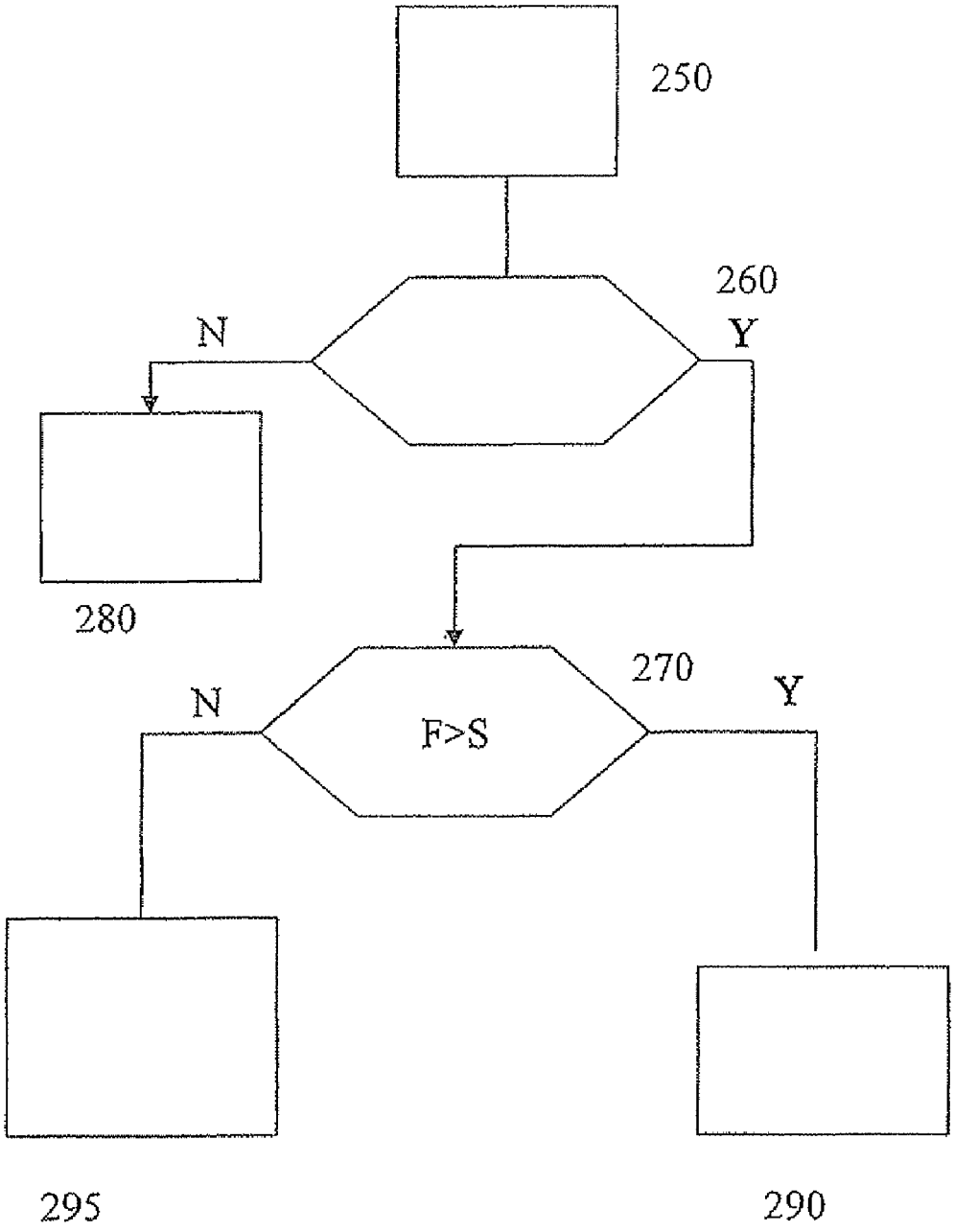
FIG. 3 shows a second flow chart, which shows the restart.

The restart is depicted in FIG. 3 as a flow chart. If a desired start of the internal combustion engine is recognized in step 250, a check is made in 260 of whether a shut-off of the internal combustion engine occurred during the previous operation. This takes place preferably via the bit set in step 240. If this is the case, query 270 checks whether the fuel level is in a range in which reliable operation is possible, i.e., it is checked whether the fuel level is greater than threshold value S. If this is the case, the internal combustion engine is started in step 290, special measures being possibly initiated to drive out the residual air from the fuel system. If query 260 detects that no shut-off is taking place, normal start occurs in step 280. If query 270 recognizes that fuel level F is insufficient, the start operation is terminated in step 295.

Alternatively it may also be provided that a check is made in step 270 of whether the tank has been filled.

What is claimed is:

1. A method for controlling an internal combustion engine having a plurality of cylinders and a fuel metering system, which includes a fuel reservoir, the method comprising:

providing a fuel level signal which characterizes a fuel level in the fuel reservoir; and when the fuel level signal drops below a threshold value, shutting off a subset of the cylinders.

2. The method according to claim 1, wherein a number of cylinders that are shut off is selected in such a way that it is sufficient for starting the internal combustion engine.

3. The method according to claim 1, wherein a number of cylinders that are not shut off is selected in such a way that it is sufficient for a limp-home operation.

4. The method according to claim 1, wherein a signal of a fuel level indicator or of an on-board computer is used as the fuel level signal.

5. The method according to claim 1, wherein the fuel level signal is ascertained on the basis of a rail pressure quantity.

6. The method according to claim 1, wherein the internal combustion engine is restarted using the shut-off cylinders.

7. A device for controlling an internal combustion engine having a plurality of cylinders and a fuel metering system, which includes a fuel reservoir, comprising:

means for providing a fuel level signal which characterizes a fuel level in the fuel reservoir; and means for shutting off a subset of the cylinders when the fuel level signal drops below a threshold value.

* * * * *